United States Patent [19]

Smith

[11] Patent Number: 4,580,080

[45] Date of Patent: Apr. 1, 1986

[54] PHASE CONTROL BALLAST

[75] Inventor: Alan M. Smith, Hendersonville, N.C.

[73] Assignee: General Electric Company, Hendersonville, N.C.

[21] Appl. No.: 543,728

[22] Filed: Oct. 20, 1983

[51] Int. Cl.[4] ..... G05F 1/00; H05B 37/02; H05B 39/04; H05B 41/36

[52] U.S. Cl. ..... 315/199; 315/291; 315/307; 315/DIG. 7; 323/243; 323/303; 323/300

[58] Field of Search ..... 315/199, 247, 291, 307, 315/308, 311, DIG. 5, DIG. 7; 323/242, 243, 288, 300, 303

[56] References Cited

U.S. PATENT DOCUMENTS

| | | | |
|---|---|---|---|
| 4,237,405 | 12/1980 | Kellis | 315/311 |
| 4,346,331 | 8/1982 | Hoge | 315/199 |
| 4,352,045 | 9/1982 | Widmayer | 315/247 |
| 4,356,433 | 10/1982 | Linden | 315/308 |
| 4,379,254 | 4/1983 | Hurban | 315/199 |
| 4,453,123 | 6/1984 | Erkman | 315/291 |
| 4,503,364 | 3/1985 | Engel | 315/308 |

*Primary Examiner*—Saxfield Chatmon
*Attorney, Agent, or Firm*—Henry J. Policinski

[57] ABSTRACT

A phase control ballast in which a reactor and a triac are connected in series with an hid discharge lamp across an ac voltage source. A supra-linear converter connected to a rectifier-filter provides a reference voltage which is a supra-linear function of the source voltage. A ramp generator provides a ramp voltage climbing at a constant rate. At the instant when the ramp voltage exceeds the level of the reference voltage, a comparator circuit provides a signal to the gate of the triac which turns it on. A triac state detector responds to the turning on of the triac in either polarity by dropping the ramp voltage to zero and holding it at zero until the triac turns itself off.

7 Claims, 7 Drawing Figures

PHASE CONTROL BALLAST

The invention relates to a discharge lamp phase control ballast in which current is regulated by varying the phase, that is the moment in the cycle of the applied voltage wave, at which a solid state switch is periodically turned on to allow current to start flowing through the lamp.

BACKGROUND OF THE INVENTION

A typical phase control ballast for a high intensity discharge (hid) lamp comprises a reactor and biiaterally conducting switching means which are connected in circuit with the lamp and an alternating voltage source such as the conventional 60 hertz ac supply. The switching means ordinarily will be a solid state switch such as a triac. A control circuit triggers the triac on with some phase delay at each half cycle of the source voltage. Ideally for a circuit in which lamp, reactor and switch are connected in series across the source a reactor is chosen that will limit the current to a value providing slightly better than rated power or wattage input to the lamp when line voltage is at its lower limit and the voltage drop across the lamp is at the nominal value. Under these circumstances the function of the control circuit is to delay or retard in phase the triggering on of the switch whenever the line voltage is above its lower limit. By so doing the current build-up during the remainder of the half cycle is limited and the wattage input into the lamp is regulated.

In general it is desired to cope with supply line variations in voltage of ±10%. As for lamp voltage variations, they can occur both as a result of manufacturing tolerances and, depending upon the kind of lamp, as a result of aging. Some high pressure sodium vapor lamps may experience a rise in arc voltage drop of as much as 50% over the life of the lamp which may exceed 20,000 hours. The extent to which the control circuit can maintain the wattage input into the lamp constant notwithstanding line and lamp voltage variations is a measure of its quality and effectiveness.

When line voltage applied to a reactor in series with a discharge lamp is increased a small amount, power into the lamp increases drastically. Therefore in using an open loop series phase control approach to regulate against line voltage variations, a linear increase in line voltage requires a supra-linear increase in the retard of the phase angle. Up to the present, a low cost supra-linear open loop feedback scheme which is precise and does not change with temperature or the inevitable variations in the parameters of circuit components was unavailable.

SUMMARY OF THE INVENTION

The object of the invention is to provide a simple low cost phase control ballast that will achieve stable operation of a high intensity discharge lamp together with superior regulation against line and lamp voltage variations. More specifically, it is desired to provide a precise supra-linear open loop feedback control circuit which does not change with temperature or with the usual variations in the parameters of circuit components, in order to achieve the foregoing desired features in a phase control ballast.

In accordance with the invention, the control circuit in a phase control ballast provides a precise and dependable reference voltage which is a predetermined function of the line voltage, and a ramp voltage which climbs in a predetermined manner and is substantially independent of line voltage. A comparator turns on the solid state switch at the instant that the ramp voltage exceeds the reference voltage. Thus the phase delay in turning on the solid state switch is governed by the reference voltage which in turn is governed by the line voltage whereby to regulate power into the lamp.

In a preferred embodiment of the invention, a bridge rectifier and filter provide at the filter output a reasonably smooth dc voltage which is proportional to ac line voltage and subject to the same percent variations. A supra-linear converter utilizes a zener diode to counter and reduce by a fixed value the filter output voltage and thereby provide a reference voltage in which the variations are a greater percentage than in the ac line. A ramp generator utilizes an operational amplifier and a transistor to maintain a constant charging current into a capacitor and thereby provide a ramp voltage climbing at a constant rate. A comparator circuit utilizing another operational amplifier turns on the solid state switch, suitably a triac, as soon as the ramp voltage exceeds the reference voltage, thereby achieving a phase delay which is a supra-linear function of line voltage. A triac state detector circuit responds to the turned on condition of the triac in either polarity by dropping the ramp voltage substantially to zero and holding it near zero. This is accomplished by discharging and maintaining discharged the capacitor of the ramp generator. The triac turns itself off when the current through it drops to zero and voltage across the triac is now of opposite polarity and immediately rises to the ac line level. At that instant, the triac state detector ceases to discharge the capacitor of the ramp generator and another ramp voltage starts climbing for another half cycle of timing and regulation.

DETAILED DESCRIPTION

Figure 1:
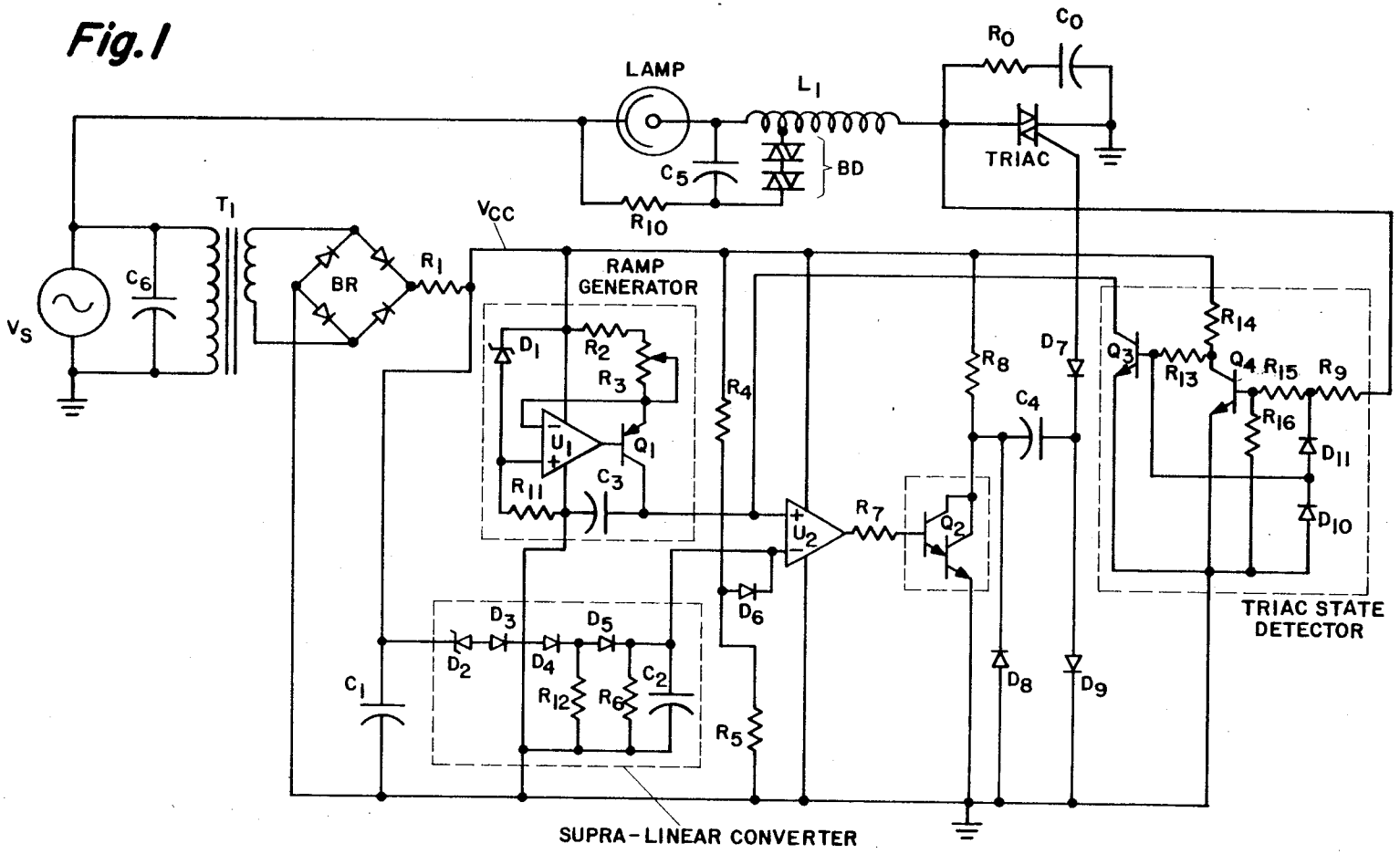
FIG. 1 is a schematic circuit diagram of a phase control ballast embodying the invention.

Referring to FIG. 1, a source of alternating voltage $V_S$ which would normally be the usual 60 hertz ac supply at a suitable voltage, the discharge Lamp, the inductor $L_1$, and the Triac form a simple series phase-control power delivery system of known kind. Typically the Lamp would be a high pressure sodium or a metal halide hid lamp. The Triac is turned on with a certain phase delay for nominal line voltage, and regulation is effected by advancing the phase for low line voltage and retarding it for high line voltage. Capacitor $C_6$ connected across the ac source or line is for power factor correction. The series combination of resistor $R_o$ and capacitor $C_o$ connected across the Triac form a voltage snubber for absorbing the voltage spike created when the Triac turns off at a current which is not quite zero. The invention resides in the novel control and triggering circuits now to be described by means of which regulation is effected.

The alternating voltage $V_S$ is stepped down by transformer $T_1$, rectified by full wave bridge rectifier BR, and filtered by series resistor $R_1$ and capacitor $C_1$ which form a low pass filter discriminating against the 3rd harmonic and above. The filter output voltage hereinafter called $V_{cc}$, is a reasonably smooth dc voltage approximately proportional to the fundamental or average value of the ac line voltage. The filter output voltage $V_{cc}$ is used to power the control and triggering circuits and also serves as a reference voltage which is an approximately linear function of ac line voltage.

Ramp Generator

Figure 2:
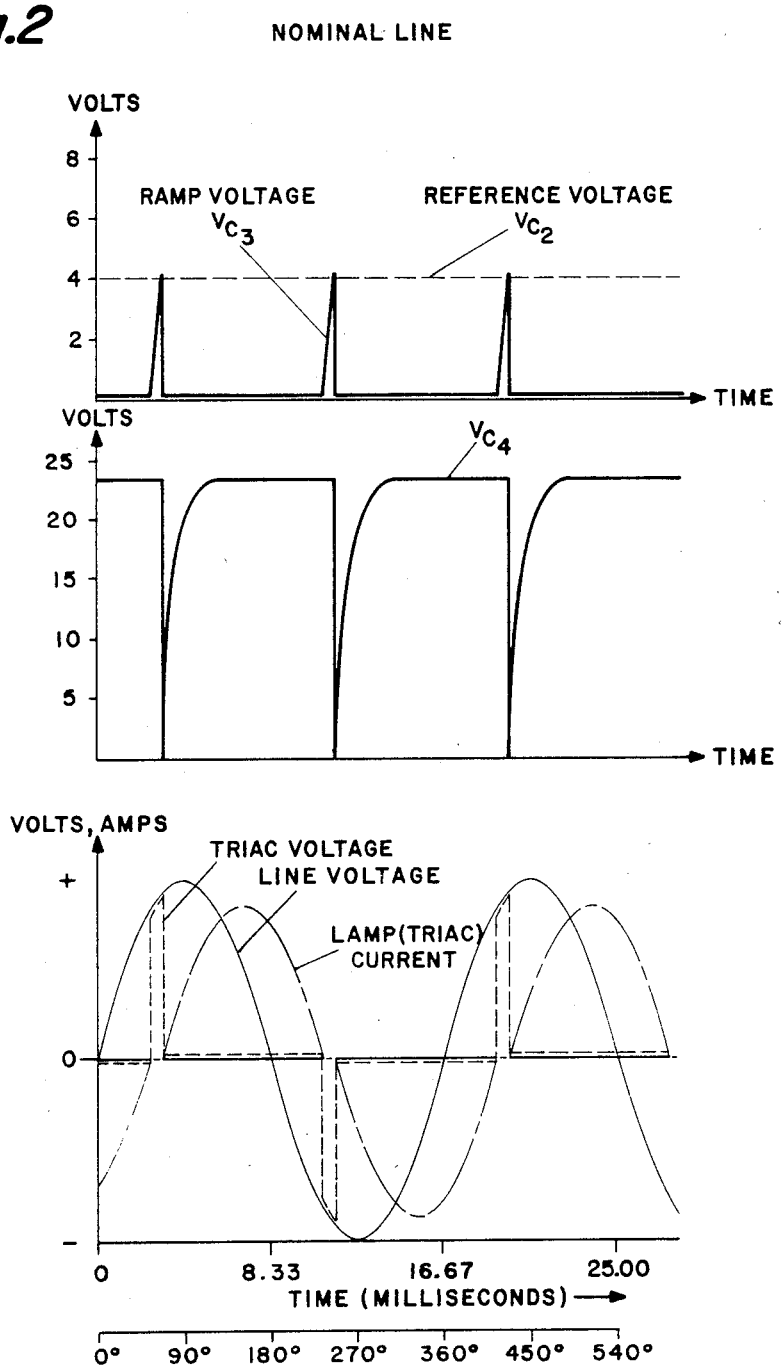
FIG. 2 is a synchrogram comprising simultaneous time charts of the supra-linear reference voltage and ramp voltage, of the voltage across the triac gate capacitor, and of line voltage, triac voltage and lamp current, all under conditions of nominal or rated line voltage.
Figure 3:
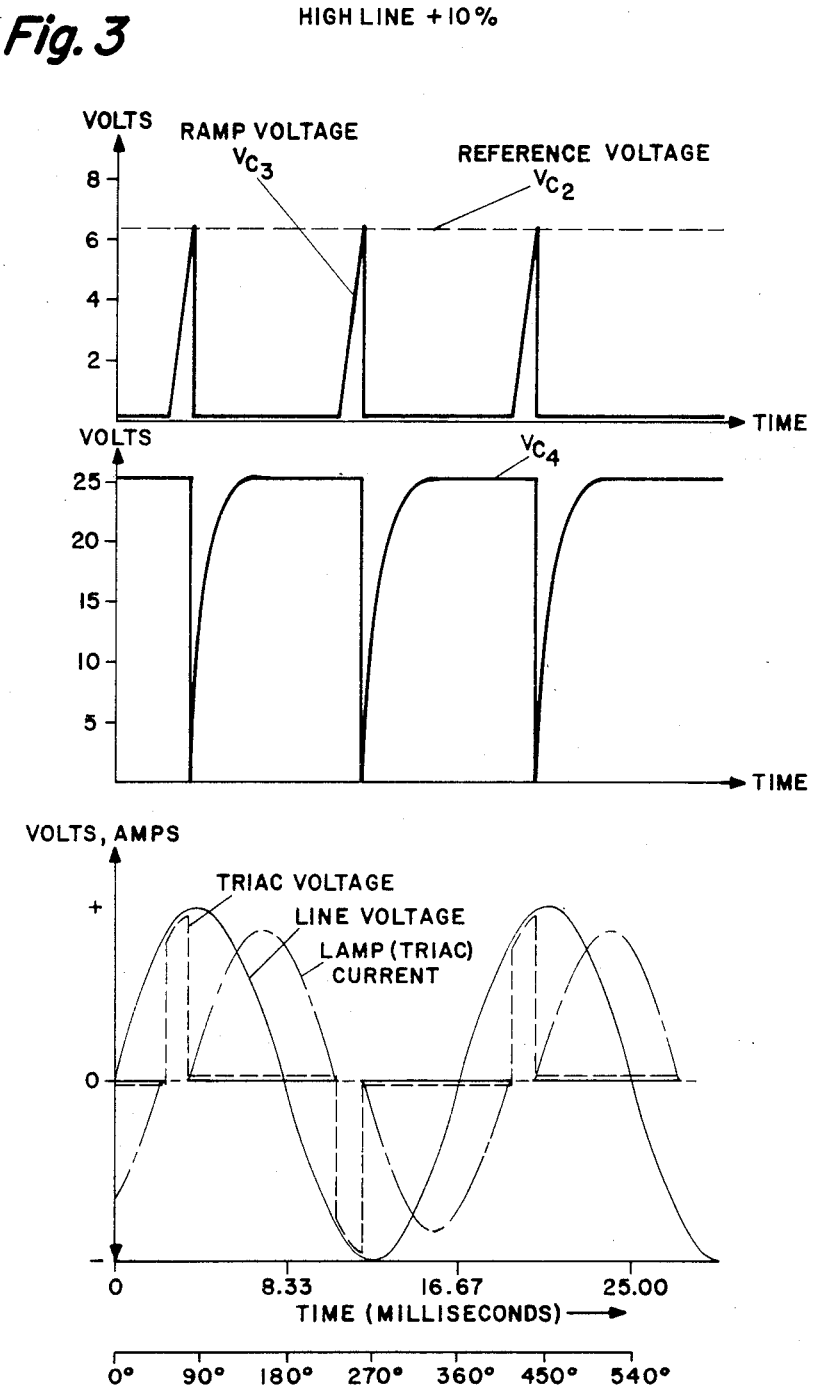
FIG. 3 is a synchrogram corresponding to that of FIG. 2 for a line voltage approximately +10% high.
Figure 4:
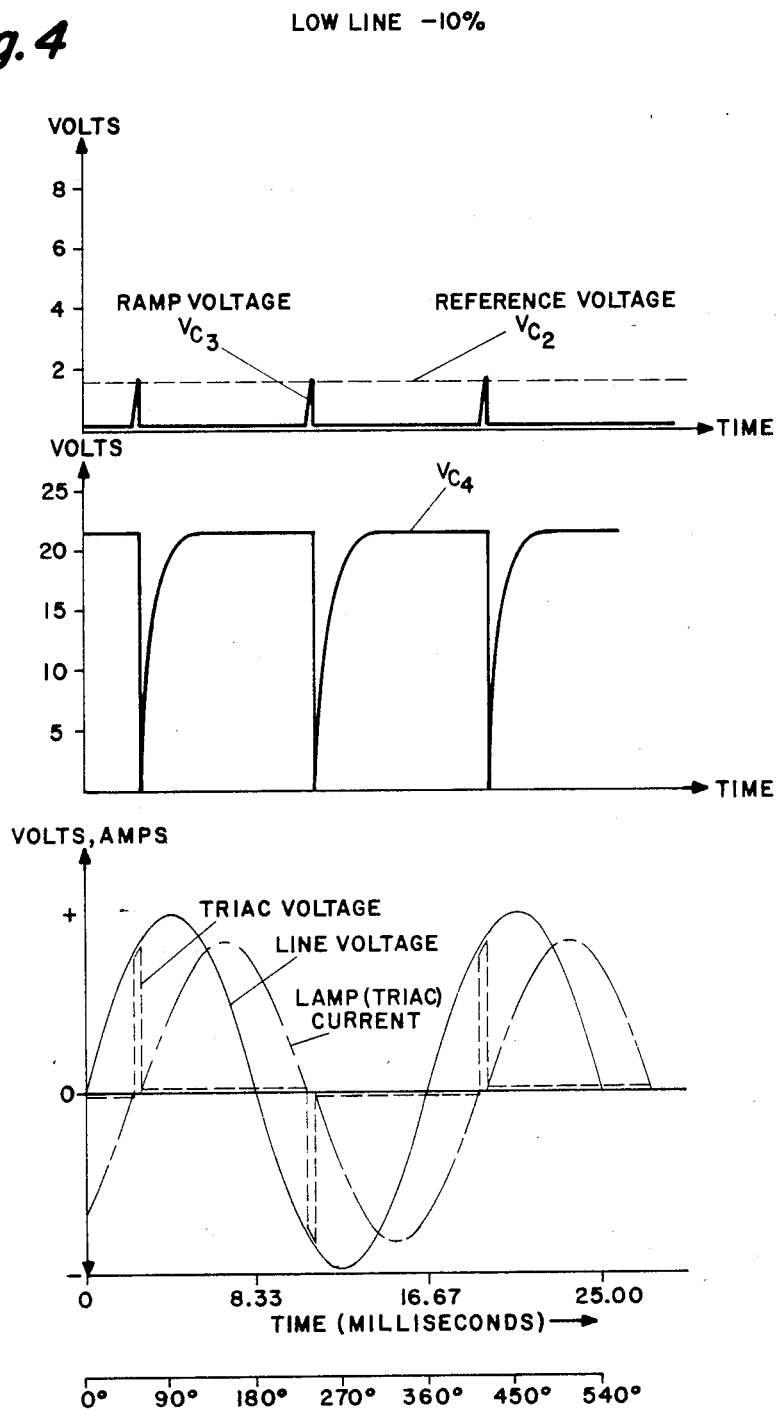
FIG. 4 is a synchrogram corresponding to that of FIG. 2 for a line voltage approximately −10% low.

Operational amplifier $U_1$, transistor $Q_1$, zener diode $D_1$, and resistors $R_2$, $R_3$, and $R_{11}$ form a constant current source which charges capacitor $C_3$ at a constant rate regardless of variations in $V_{cc}$ consequent on ac line voltage variations. This is so because the current drawn by $R_{11}$ assures breakdown of zener diode $D_1$ resulting in a constant bias below $V_{cc}$ at $U_1+$. The operational amplifier provides a signal to the base of transistor $Q_1$ which determines current flow through $Q_1$. The flow through $Q_1$ will be whatever current produces a voltage drop across $R_2$ and $R_3$ making the voltage at $U_1-$ substantially equal to that at $U_1+$. Since the voltage at $U_1+$ is constant, the current will be constant. Hence ramp capacitor $C_3$ will be charged at a constant rate and a ramp voltage climbing at a constant rate will be produced across it. While a ramp voltage climbing at a constant rate is preferred, a ramp voltage climbing in some other predetermined manner may also be used. The ramp voltage $V_{C3}$ initiated at each half cycle of line voltage and is constant in slope but may reach different heights, as shown in FIGS. 2, 3 and 4.

Supra-linear converter

Zener diode $D_2$ and resistor $R_{12}$, plus diodes $D_3$, $D_4$ and $D_5$ form a supra-linear converter relative to the ac line voltage-induced variations in $V_{cc}$. The current drawn by $R_{12}$ assures breakdown of zener diode $D_2$ whereby a large portion of the dc component is removed from $V_{cc}$, resulting in a reference level across $R_6$ which is disproportionately responsive to fluctuations in ac line voltage. The voltage across $R_6$ may be termed a reference voltage which is a supra-linear function of the ac line voltage and wherein the variations are a greater percentage of the average than in the ac line. Diodes $D_3$, $D_4$ and $D_5$ have constant voltage drops adding to that across $D_2$ but much smaller in magnitude, and have negative temperature coefficients to compensate for the positive temperature coefficient of zener diode $D_2$. By way of example, assume $V_{cc}$ is 24 volts at nominal line voltage, and the constant voltage drops are 18.5 volts across $D_2$, and 0.5 volts across each of $D_3$, $D_4$, and $D_5$. This leaves 4 volts as the reference voltage across $R_6$. Suppose now a 10% rise in ac line voltage causing $V_{cc}$ to rise from 24 to 26.4 volts, an increase of 2.4 volts. The same absolute increase of 2.4 volts will occur across $R_6$ with a rise from 4 to 6.4 volts. Thus the 10% increase in line voltage produces a 60% increase in the reference voltage and the circuit may be termed a supra-linear converter The function of capacitor $C_2$ in combination with resistor $R_6$ is to further average the supra-linear reference voltage. The voltage-dropping combination of $R_4$ and $R_5$ together with $D_6$ determines a minimum voltage across $R_6$ or $C_2$ to supplement the normal reference voltage at very low ac line voltage. The supplemental voltage prevents erratic firing of the Triac at low line voltage and maintains the Lamp in operation even though without regulation.

Comparator Circuitry

The ramp voltage generated across capacitor $C_3$ is supplied to the + terminal of operational amplifier $U_2$ while the supra-linear reference voltage developed across capacitor $C_2$ is supplied to the − terminal. $U_2$ serves as comparator whose output goes high at the instant when the ramp voltage at $U_2+$ exceeds the reference voltage at $U_2-$. The output is supplied through resistor $R_7$ to the control base of Darlington transistor pair $Q_2$, turning it on and thereby discharging capacitor $C_4$.

Capacitor $C_4$ is normally positively charged from $V_{cc}$ through resistor $R_8$ and diode $D_9$. Such charge prevents current flow through diode $D_7$ and the gate of the Triac. At the instant comparator $U_2$ goes high and causes $Q_2$ to discharge capacitor $C_4$, such discharge of $C_4$ draws current through the gate of the Triac and turns it on. Assuming the Lamp is already ionized, current rises and then falls in a near-sinusoidal manner through the Lamp, eventually returning to zero value. The function of diode $D_8$ is to prevent breakdown of transistor $Q_2$ as a result of inductive kick from the main power loop through the gate of the Triac.

Triac State Detector

At the instant the Triac is turned on, the voltage across it decreases suddenly from a large positive or negative value to a small positive or negative value, depending upon the polarity of $V_S$ during the half cycle in question. Also when the current through Lamp and Triac approaches zero, the Triac turns itself off and the voltage across it suddenly increases to a large value opposite in polarity to the polarity during the preceding half cycle. At the first event above—Triac turn-on—, it is desired to discharge ramp capacitor $C_3$ and hold it discharged until the occurrence of the second event—Triac turn-off—, whereupon charging of $C_3$ can start again. This is accomplished by the triac state detector circuit comprising transistors $Q_3$ and $Q_4$, diodes $D_{10}$ and $D_{11}$, and resistors $R_9$, $R_{13}$, $R_{14}$, $R_{15}$ and $R_{16}$. The circuit operates in a way to turn on transistor $Q_3$ whenever the Triac is on, irrespective of the direction of current flow through it. When $Q_3$ is on, it discharges the ramp voltage accumulated across capacitor $C_3$ and keeps $C_3$ discharged by draining the constant current produced by the ramp generator. Turning off $Q_3$ allows the ramp voltage $V_{C3}$ to start climbing.

The triac state detector operates differently on positive half cycles than on negative half cycles but accomplishes the same result. Assuming the Triac is turned off on a positive half cycle, the high positive voltage supplied to $R_9$ is divided down by $R_9$, $R_{15}$ and $R_{16}$ and turns on transistor $Q_4$. The current flow through $Q_4$ prevents any base current through transistor $Q_3$ which is thereby turned off, allowing the ramp voltage to climb. If the Triac is turned off on a negative half cycle, the high negative voltage supplied to $R_9$ will draw current from ground through diodes $D_{10}$ and $D_{11}$. The voltage drop across $D_{10}$, typically −0.5 volt, will keep transistor $Q_3$ turned off, again allowing the ramp voltage to climb.

When the Triac is turned on, a low positive or negative voltage, typically less than 1 volt, will be supplied to $R_9$ on the positive or negative half cycle. The low positive voltage will be insufficient to turn on $Q_4$. Hence base current will be supplied through $R_{14}$ and $R_{13}$ to turn on transistor $Q_3$ which will discharge ramp capacitor $C_3$ and drain the constant current produced by the ramp generator. The low negative voltage supplied to $R_9$ will be insufficient to forward bias diodes $D_{10}$ and $D_{11}$. As a result base current is supplied through resistors $R_{14}$ and $R_{13}$ to transistor $Q_3$. Hence $Q_3$ becomes turned on, discharges ramp capacitor $C_3$, and drains the constant current produced by the ramp generator in the same way as on the positive half cycle.

Lamp Starting

It has been assumed up to now that the lamp is already started and ionized but in fact a generally conventional starting circuit is provided to start the lamp. The circuit comprises charging capacitor $C_5$ and a voltage-sensitive breakdown switch device, here represented as a series pair of sidacs BD which are connected to form a series discharge loop with a small number of primary turns at the output or lamp end of reactor $L_1$. Resistor $R_{10}$ is connected in series with capacitor $C_5$ form a charging circuit in parallel with the lamp. When the sidac pair breaks down, the sudden rush of capacitor discharge current through the few primary turns generates a high voltage low energy pulse throughout the entire inductor $L_1$. The pulse is applied in series with the alternating source voltage $V_S$ across the Lamp electrodes. Pulsing continues until the Lamp starts and then is automatically discontinued as the voltage drop across the Lamp becomes less than the sidac breakdown voltage. Such starting circuits are well known and are disclosed for instance in Pat. No. 3,963,958—Nuckolls.

Timing Sequence

The timing sequence is shown in FIG. 2 for conditions corresponding to nominal or rated line voltage, in FIG. 3 for conditions corresponding to 10% overvoltage, and in FIG. 4 for conditions corresponding to 10% undervoltage. The time interval spanned is approximately $1\frac{3}{4}$ periods, or $3\frac{1}{2}$ half-periods, each half-period having an angular span of 180° and being 8.33 milliseconds in actual time when using conventional 60 hertz power.

The lower chart shows line voltage in solid line, voltage drop across the Triac in broken line, and Lamp current in dot-dash line. The lamp current is shown lagging effectively 60° to 65° behind line voltage. At 0°, the Triac is initially on, the lamp current is negative and decreasing, and the voltage across the Triac is low and negative. At about 55°, lamp current drops to zero and the Triac turns itself off. Immediately thereafter the voltage drop across the Triac goes high positive, substantially to the ac line level. The high positive Triac voltage turns off transistor $Q_3$ in the triac state detector which allows the ramp voltage to start climbing as shown in the upper chart.

The ramp voltage climbs until it reaches the reference level $V_{C2}$ set by the supra-linear converter. When that happens comparator $U_2$ turns on transistor $Q_2$ which discharges gate capacitor $C_4$ through the gate of the Triac, turning it on. The intermediate chart shows the pattern of voltage $V_{C4}$ across gate capacitor $C_4$. The voltage across the Triac immediately drops to a low positive value and current through the lamp starts to rise. When the Triac voltage drops to a low positive value, $Q_3$ in the triac state detector is turned on which discharges ramp capacitor $C_3$ and holds it discharged. With the Triac on, current through the series combination of Lamp, inductor $L_1$, and Triac rises positively and then falls according to a generally sinusoidal pattern.

When current becomes zero at about 235°, the Triac turns itself off. Immediately thereafter the voltage drop across the Triac goes high negative, substantially to the instantaneous ac line level, and turns off transistor $Q_3$ in the triac state detector. This allows the ramp voltage $V_{C3}$ to start climbing again for the second time as shown in the upper chart. When the ramp voltage reaches the reference level $V_{C2}$, comparator $U_2$ turns on transistor $Q_2$ which turns on the Triac. The voltage across the Triac immediately drops to a low negative value and current through the lamp starts to increase negatively. When the Triac voltage drops to a low negative value, transistor $Q_3$ in the triac state detector is turned on which discharges ramp capacitor $C_3$ and holds it discharged. With the Triac on, current now rises negatively and then falls according to the near-sinusoidal pattern. When current becomes zero, the Triac turns itself off and the cycle repeats.

Regulation of Power to Lamp

The manner of regulating power to the lamp can be seen by comparing FIGS. 2, 3 and 4. When ac line voltage is increased, $V_{C2}$ is higher as in FIG. 3, and the ramp voltage $V_{C3}$ takes longer to reach the $V_{C2}$ level. This delays the discharge of $V_{C4}$ by transistor $Q_2$ so the Triac is turned on later. Lamp current has less time in which to rise and is effectively reduced. When ac line voltage is decreased, $V_{C2}$ is lower as in FIG. 4, and ramp voltage $V_{C3}$ reaches the $V_{C2}$ level sooner. Hence the Triac is turned on earlier and Lamp current is effectively augmented. Thus higher line voltage is applied across Lamp and inductor $L_1$ for a shorter time, and lower voltage is applied for a longer time, so that power to the Lamp tends to remain constant for a given lamp voltage. The broadening of the triac voltage rise in FIG. 3 corresponds to phase delay while the narrowing in FIG. 4 corresponds to phase advance.

Start Current Control

According to another feature of my invention, the phase control circuit can be used to limit lamp starting current. In an economic design of the reactor $L_1$ for the present phase control ballast, it may be difficult to keep the flux density in a particular core structure within reasonable limits and yet prevent excessive current at starting. In an installation where many luminaires are controlled from a central point and turned on simultaneously, limitation of start current may be crucial. By delaying the firing angle at start, one may realize a decrease in flux density during lamp starting. The decrease may be great enough to allow the reactor to operate in a linear mode even at starting.

Figure 5:
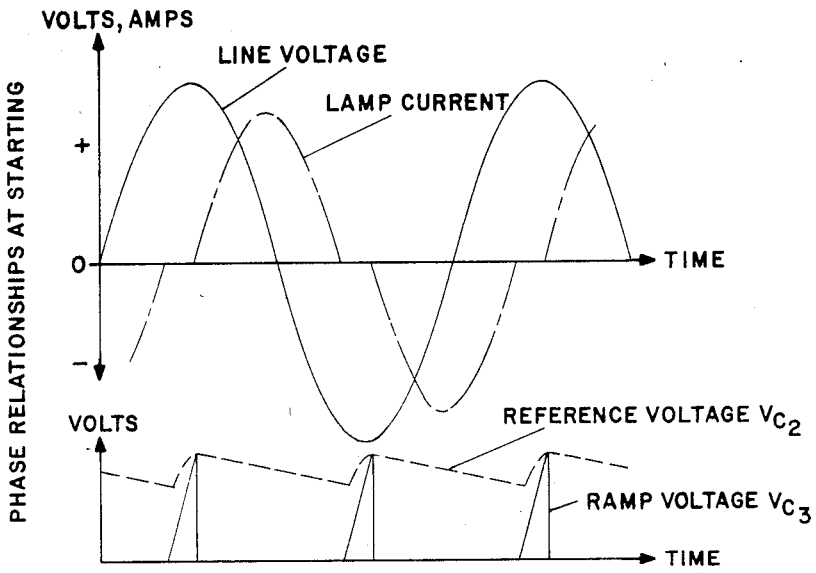
FIG. 5 is a synchrogram comprising line voltage and lamp current at starting, and a high ripple supralinear reference voltage and associated ramp voltage.
Figure 6:
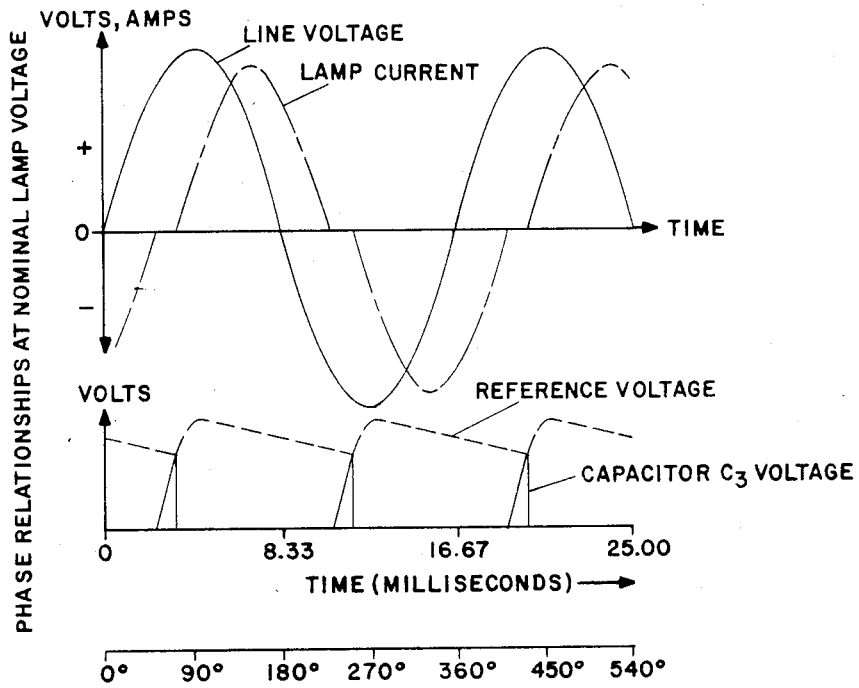
FIG. 6 is a synchrogram corresponding to that of FIG. 5 for normal lamp operation.

To limit current at starting, the filtering of the output of bridge rectifier BR by filter $R_1C_1$ is limited to leave appreciable 120 hertz ripple in the filter output voltage $V_{cc}$. The ripple is transmitted through the supra-linear converter, and the control of start current is made possible by the ripple on $V_{C2}$, the supra-linear reference voltage across $C_2$ or $R_6$. The phase relationship between this ripple voltage and ac line voltage does not change with changing load conditions in the main power loop: however, the phase angle between line voltage and line current does change, for example, from about 75° lagging at start to about 55° lagging in normal operation at nominal lamp voltage. As can be seen in FIGS. 5 and 6, this results in an effectively higher instantaneous reference voltage across $C_2$ at lamp starting than at nominal lamp voltage. Hence more time is required for the ramp voltage $V_{C3}$ to reach the instantaneous level of reference voltage $V_{C2}$, so that comparator $U_2$ goes high later in the half cycle at lamp starting. As a result, the Triac fires later in each half cycle, applying line voltage for a shorter length of time so that lamp current cannot build up as high. Thus simply by adjusting the amount of ripple on the reference voltage, the invention achieves control or limitation of start current.

Higher Voltage Adaptation

Figure 7:
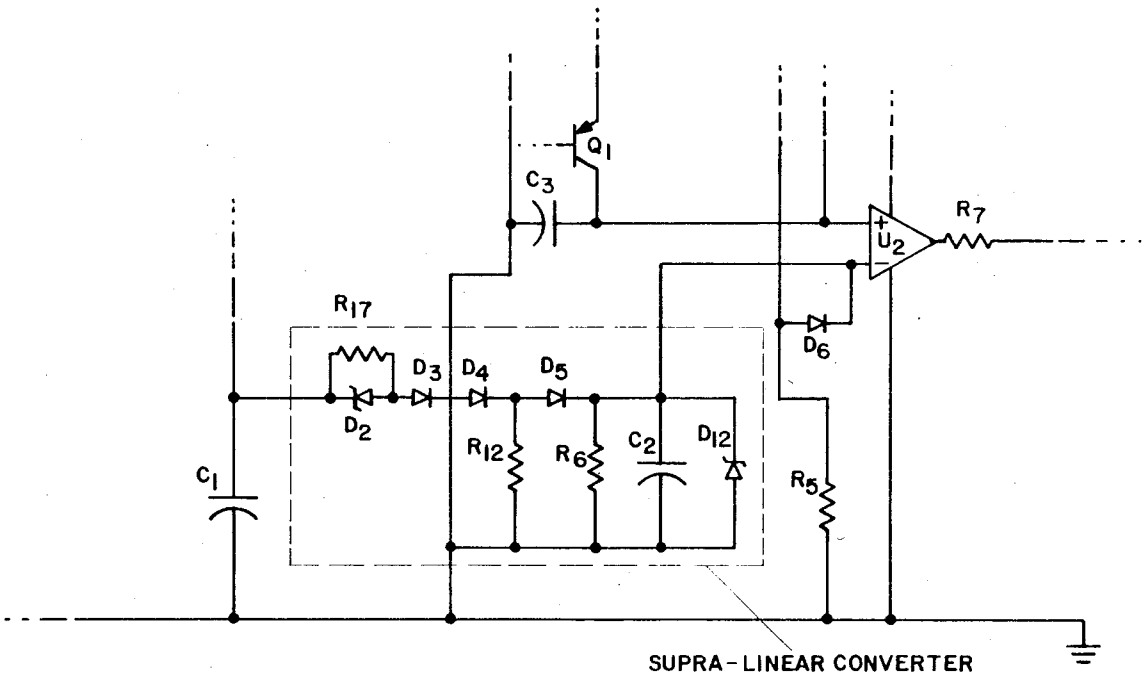
FIG. 7 is a schematic circuit diagram of a modified version of the supra-linear converter to allow operation of the ballast with the same reactor on a higher line voltage.

The control circuit embodying the invention requires only a few modifications to allow operation on higher line voltages while still maintaining lamp power within prescribed limits. The modifications involve the ballast inductor $L_1$, and the supra-linear converter circuit. As shown in FIG. 7, the supra-linear converter has a resistor $R_{17}$ connected across zener diode $D_2$, and a zener diode $D_{12}$ connected in parallel with capacitor $C_2$. Resistor $R_{17}$ is sized so that at low line voltage, diode $D_2$ is below its conduction voltage. If When ballast inductor $L_1$ is sized properly, the ballast characteristics curve is acceptable under this condition. Furthermore, the reference voltage will increase proportionally to line voltage increases until $D_2$ begins to conduct, typically at a point just below nominal line voltage. Now as line voltage continues to increase, the comparator reference voltage increases disproportionately to line voltage causing the triac to fire much later in the half cycle at nominal and high line voltage than at lower line voltages. Diode $D_{12}$ places an upper limit on phase angle retardation. In this way, the characteristic ballast curves for nominal and low line are kept very close to the low line characteristic curve.

The phase control ballast of my invention is low in cost and light in weight, weighing for instance 9 lbs. as against 18 lbs. for an equivalent magnetic regulator ballast for a 400 watt high pressure sodium vapor lamp. It achieves regulation against line voltage variation which is superior to that obtained with a high quality magnetic regulator.

The particular embodiments with preferred choices and connections of components which have been illustrated and described are intended by way of example, and numerous modifications may be made by those skilled in the art without departing from the scope of the invention. The appended claims are intended to cover all such variations coming within the true spirit and scope of the invention.

What I claim as new and desire to secure by Letters Patent of the United States is:

1. A phase control ballast for operating a discharge lamp from a source of alternating voltage comprising:

a reactor and bilaterally conducting switching means adapted to be connected in circuit with said lamp and said source, said switching means being operable at a variable phase relative to the source voltage for controlling current to the lamp, a converter providing a reference voltage which is a supra-linear function of the source voltage, a ramp generator providing a ramp voltage climbing in a predetermined manner, a comparator circuit turning on said switch means when the ramp voltage exceeds the level of the reference voltage, and a switching state detector responding to the turning on of said switching means in either polarity by discharging the ramp voltage substantially below the reference voltage until the switching means is turned off.

2. A ballast as in claim 1 wherein said switching means is a solid state switch which is capable of being turned on in either polarity, and which, after being turned on, will conduct until the current drops substantially to zero and thereupon will turn itself off.

3. A ballast as in claim 1 wherein said comparator circuit comprises an operational amplifier which is supplied the reference voltage at one input and the ramp voltage at the other input, and a transistor which is turned on by the output of the operational amplifier when the ramp voltage exceeds the level of the reference voltage, said transistor being connected to turn on said switching means at the moment when it is turned on.

4. A phase control ballast for operating a discharge lamp from a source of alternating voltage comprising:

a reactor and a triac adapted to be connected in series with said lamp across said source, the triac having a gate allowing turning on at a variable phase relative to the source voltage for controlling current to the lamp, rectifier means energized by said source and including a supra-linear converter providing a reference voltage which is a supra-linear function of the source voltage, a ramp generator maintaining a constant charging current into a capacitor to provide a ramp voltage climbing at a constant rate, a comparator circuit providing a signal to the gate of the triac to turn it on when the ramp voltage exceeds the level of the supra-linear reference voltage, and a triac state detector responding to the turning on of the triac in either polarity by discharging and maintaining discharged the capacitor of the ramp generator until the triac turns itself off.

5. A ballast as in claim 4 wherein said supra-linear converter comprises a zener diode connected across the output of the rectifier means in series with a resistor, said resistor drawing sufficient current to assure breakdown of said zener diode whereby a large portion of the dc component is removed from said output, the removal of said portion resulting in a reference level across said resistor which is disproportionately responsive to fluctuations in ac line voltage.

6. A ballast as in claim 5 wherein said supra-linear converter includes at least one forwardly conducting diode connected in series with said zener diode and said resistor, said diode having a negative temperature coefficient to compensate for a positive temperature coefficient in the zener diode.

7. A ballast as in claim 5 having a limited starting current wherein said rectifier means is designed to leave a substantial ripple component at double line frequency in its output transmitted through said supra-linear converter, said ripple component resulting in a higher instantaneous level in the reference voltage at the instant when the ramp voltage exceeds it at starting, whereby additional delay in turning on the triac is introduced at starting.

* * * * *